US008290191B2

(12) United States Patent
Nielsen

(10) Patent No.: US 8,290,191 B2
(45) Date of Patent: Oct. 16, 2012

(54) ADAPTER SHOE AND A COMBINATION OF ADAPTER SHOE AND HEARING AID

(75) Inventor: Dennis Brian Nielsen, Helsinge (DK)

(73) Assignee: Widex A/S, Lynge (DK)

( * ) Notice: Subject to any disclaimer, the term of this patent is extended or adjusted under 35 U.S.C. 154(b) by 1114 days.

(21) Appl. No.: 12/103,620

(22) Filed: Apr. 15, 2008

(65) Prior Publication Data

US 2008/0192970 A1 Aug. 14, 2008

Related U.S. Application Data

(63) Continuation-in-part of application No. PCT/DK2005/000666, filed on Oct. 17, 2005.

(51) Int. Cl.
*H04R 25/00* (2006.01)

(52) U.S. Cl. ..... 381/323; 381/324

(58) Field of Classification Search ..... 381/312, 381/324, 330, 380, 322, 323; 320/110, 112, 320/113, 114
See application file for complete search history.

(56) References Cited

U.S. PATENT DOCUMENTS

| | | | | |
|---|---|---|---|---|
| 3,828,142 | A * | 8/1974 | Buttner | 381/323 |
| 4,137,431 | A | 1/1979 | Pallesen | |
| 4,947,439 | A | 8/1990 | Buettner | |
| 5,588,064 | A | 12/1996 | McSwiggen et al. | |
| 6,034,505 | A * | 3/2000 | Arthur et al. | 320/113 |
| 7,068,804 | B2 * | 6/2006 | Batting | 381/330 |
| 7,166,987 | B2 * | 1/2007 | Lee et al. | 320/114 |
| 2006/0034474 | A1 * | 2/2006 | Topholm et al. | 381/322 |

FOREIGN PATENT DOCUMENTS

| | | | |
|---|---|---|---|
| CH | 675657 | A5 | 10/1990 |
| DE | 29916350 | U1 | 2/2000 |
| WO | WO0251203 | A1 | 6/2002 |
| WO | WO2004073351 | A1 | 8/2004 |
| WO | WO2004080123 | A1 | 9/2004 |

* cited by examiner

*Primary Examiner* — Yuwen Pan
*Assistant Examiner* — Phan Le
(74) *Attorney, Agent, or Firm* — Sughrue Mion, PLLC

(57) ABSTRACT

A combination of a hearing aid (1) and an adapter shoe (13), wherein the hearing aid has a pivotable battery compartment (6), and wherein the adapter shoe has engagement means (14, 15) for engaging the exterior of the hearing aid housing, blocking means (21) for blocking pivoting of the pivotable wall, and engagement means (23) for engaging the pivotable wall. The invention also provides an adapter shoe and a method of attaching an adapter shoe.

10 Claims, 6 Drawing Sheets

ADAPTER SHOE AND A COMBINATION OF ADAPTER SHOE AND HEARING AID

RELATED APPLICATIONS

The present application is a continuation-in-part of application No. PCT/DK2005/000666; filed on 17 Oct. 2005, in Denmark and published as WO 2007045236, the contents of which are incorporated hereinto by reference.

FIELD OF THE INVENTION

The present invention relates generally to hearing aids. The invention further relates to methods of connecting accessories to hearing aids. The invention more specifically relates to a combination of an adapter and an accessory for a hearing aid, in particular a BTE hearing aid.

BACKGROUND OF THE INVENTION

As used in this context, a hearing aid is understood as generally comprising a device with an input transducer for transforming an acoustic input signal into a first electrical signal, a signal processor for generating a second electrical signal based on the first electrical signal, an output transducer for conversion of the second signal into sound, and a battery for supplying power to the signal processor.

Behind-the-ear (BTE) hearing aids is the term commonly used for a hearing aid having most of the components arranged inside a curved housing adapted for resting over the external ear (the pinna), usually combined with a plug for insertion in the ear canal and with an acoustic conduit for conveying the amplified sound from the receiver placed in the BTE housing and to the plug.

Within the present context, an adapter shoe for a hearing aid designates a device for optional fastening to a hearing aid. The adapter shoe usually serves the purpose of temporarily attaching equipment for use together with the hearing aid, for implementing some specific functionality not incorporated inside the hearing aid, or for providing a connection between the hearing aid and external equipment. The adapter shoe may incorporate means for providing electrical connections to appropriate contact pads of the hearing aid.

An accessory of relevance to the invention comprises a radio receiver such as an FM receiver adapted for receiving an FM radio signal, converting the FM signal into an audio signal and providing the audio signal to the hearing aid, where the audio signal is fed into the hearing aid input circuitry. Other accessories of relevance comprise wireless receivers in general, infrared receivers, connectors for interfacing with other connector systems, audio cables for connection to an external source or another hearing aid, and a programming cable for programming the hearing aid.

U.S. Pat. No. 4,947,439 provides a hearing aid with a contact arrangement for electrically connecting a battery power supply to electrical components of the hearing aid. The battery power supply is carried in a compartment which is pivotally attached to the hearing aid housing and pivoting of the compartment places the battery into contact with spring contacts to thereby provide electrical power to the electrical components of the hearing aid and to thereby turn on the hearing aid.

DE-U-29916350 shows a hearing aid with a pivotable battery compartment adapted for serving as a power switch and with a sliding element serving as a lock for the switch. The battery compartment is provided with a protruding lip to facilitate manipulation.

U.S. Pat. No. 5,588,064 shows a hearing aid with a battery compartment formed as a drawer or a holder. The holder has a pivot point about which the holder rotates when it is pushed into the housing. The pivoting motion, or at least a part of it, may be used to slide the battery terminals over a set of contacts, thereby allowing the motion also to be used for performing switching functions WO-A1-02/51203 shows a communication system comprising a housing adapted for placement behind an ear, the housing comprising a battery compartment which is pivotally mounted on the housing, and which has a recess. The communication system comprises a communication element, which has a protruding element adapted for engagement with the recess in the battery compartment in such a manner that the communication element may be pivoted together with the battery compartment.

WO-A-2004/073351 shows a hearing aid with a removable battery compartment, wherein the battery compartment can be pivoted to manipulate a power switch and to allow exchange of the battery, and where there is a security lock to prevent accidental loss of the battery.

WO-A-2004/080123 shows a combination unit for attachment to a hearing aid, comprising an adapter shoe and an accessory. The hearing aid is provided with a pivotable battery compartment for use as a power switch. The adapter comprises a shoe, i.e. a sleeve-like structure, adapted to partially enclose the lower portion of the hearing aid. The adapter shoe is provided with small ribs for engaging grooves in the hearing aid housing for mechanical engagement. The sleeve leaves open access to part of the rear side of the hearing aid housing in order to allow manipulating the hearing aid power switch.

Access to manipulating the switch is favored by many users. There may, however, be users preferring some way of blocking that access. This may e.g. be the case in a classroom situation with minors, or others, not knowing how to operate the switch, where it would be preferred to have a teacher assume responsibility of switching on the hearing aid with accessories.

The adapters will by inherently be provided as an optional accessory, suitably tailored to the specific shape of hearing aid housing. As the greater part of users will use the hearing aids without adapters, there is an emphasis on providing an attractive design of the hearing aid housing on its own, making it less attractive to provide the housings with very conspicuous connection details. This can make it difficult to devise sturdy connections that will avoid accidental loss of the adapters. Therefore, there is great interest to devise adapters that can cling on to very tiny connection details, e.g. shallow grooves and small ribs as may be there.

SUMMARY OF THE INVENTION

It is an object of the invention to provide an accessory for a hearing aid that is easily attached and detached, even for those with impaired finger agility.

It is a further object of the invention to provide an accessory for a hearing that has a secure retention on the hearing aid.

It is another object of the invention to provide a means for optionally securing the hearing aid power switch.

The invention, in a first aspect, meets this object by providing a combination of a hearing aid and an adapter shoe, wherein the hearing aid has a housing and a pivotable battery compartment, and wherein the adapter shoe has engagement means for engaging the exterior of the hearing aid housing, a slider for selective engagement with the hearing aid housing and the battery compartment for blocking pivoting of the battery compartment and snap lock means for engaging the battery compartment.

This combination provides a very sturdy engagement of the adapter shoe to the hearing aid housing so as to minimize the risk of the adapter shoe being lost. The adapter shoe according to the invention utilizes the pivotable wall for retention. In most hearing aids, the pivotable wall pivots downwards, and therefore is generally not suitable for relying on as a means for an adapter shoe to cling onto. According to the invention, however, means are provided to block the pivoting of the wall, and therefore the wall can be used for seizure.

The combination further prevents the accidental switching off of the hearing aid, thereby providing a child-proof locking of the hearing aid switch.

According to an embodiment, the engagement means may comprise a slider with snap lock means for selective engagement with the adapter shoe. This permits removing the engagement means when necessary, and it provides a simple option for trimming the force required to overcome the lock, e.g. through providing a selection of sliders offering different degrees of locking force.

The invention, in a second aspect, provides an adapter shoe for a hearing aid having a housing and a pivotable battery compartment, wherein the adapter shoe has engagement means for engaging the exterior of the hearing aid housing, a slider for selective engagement with the hearing aid housing and the battery compartment for blocking pivoting of the battery compartment and snap lock means for engaging the battery compartment.

This adapter shoe provides a very sturdy grip onto the hearing aid housing, and it provides a lock for preventing accidental switching off of the hearing aid.

The invention, in a third aspect, provides a method of attaching an adapter shoe to a hearing aid having a housing and a pivotable battery compartment, comprising engaging the hearing aid housing and the battery compartment by the adapter shoe, whereby to block the pivoting of the battery compartment, and providing a slider for selective engagement with the battery compartment.

The invention, in a fourth aspect, provides a combination of a hearing aid and an adaptor shoe, wherein the hearing aid has a housing and a pivotable battery compartment, and wherein the adaptor shoe has engagement means for engaging the exterior of the hearing aid housing whereby to blot pivoting of the battery compartment, and a pivotable arm for securing the engagement with the exterior of the hearing aid housing.

Further embodiments appear from the dependent claims.

Further objects, embodiments and advantages will appear from the detailed part of the specification.

BRIEF DESCRIPTION OF THE DRAWINGS

The invention will now be described in more detail with reference to the accompanying drawings, where.

DETAILED DESCRIPTION

Figure 1:
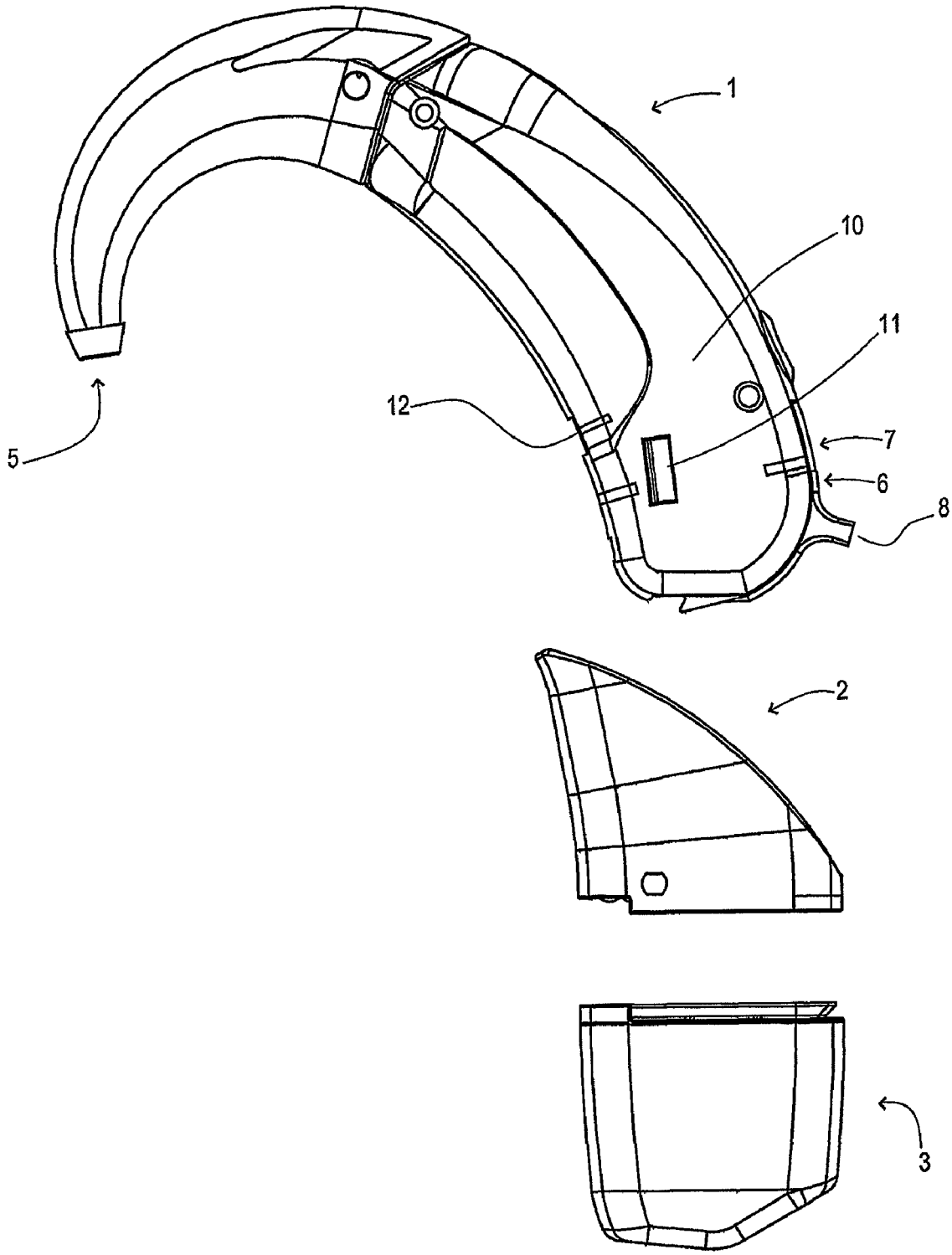
Fig. 1 PRIOR ART
FIG. 1 illustrates a BTE hearing aid, an adapter shoe and an accessory according to the prior art, in exploded view.
Figure 3:
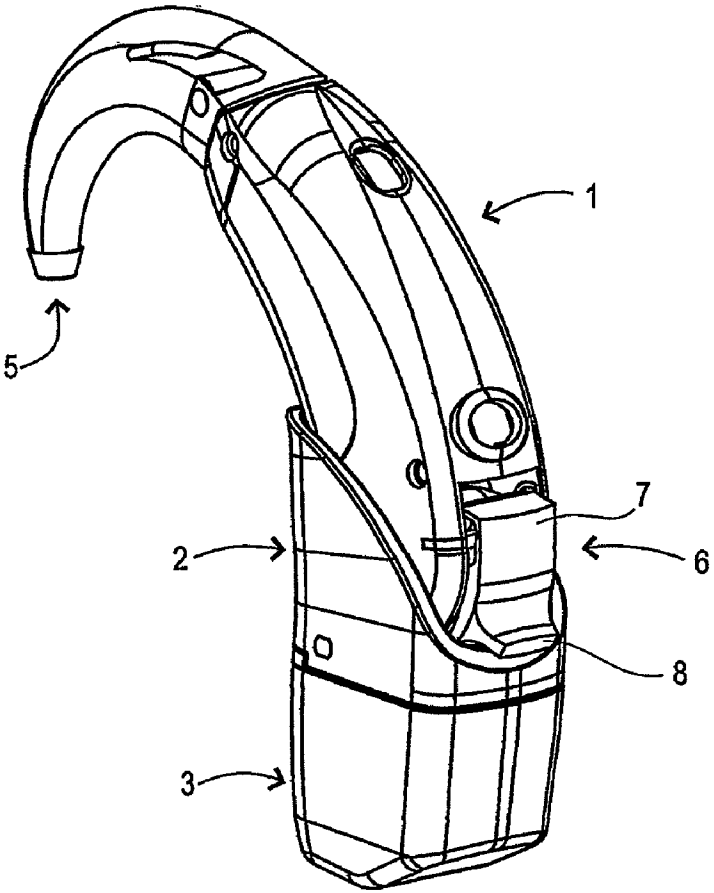
Fig. 3 PRIOR ART
FIG. 3 illustrates the hearing aid, the adapter and the accessory of FIG. 1, with the battery drawer in a different position.
Figure 2:
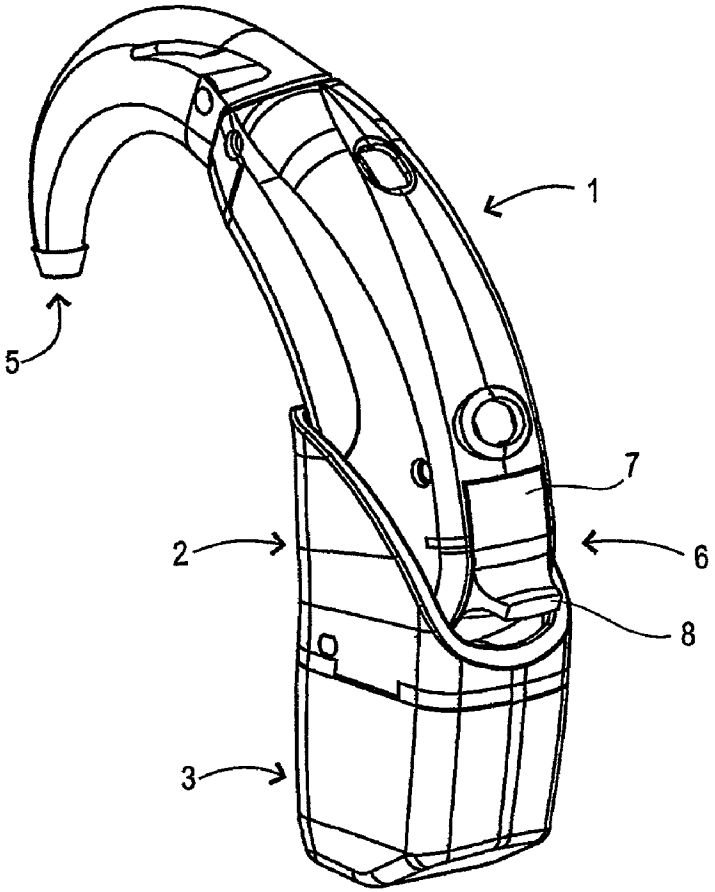
Fig. 2 PRIOR ART
FIG. 2 illustrates the hearing aid, the adapter and the accessory of FIG. 1.

Reference is first made to FIGS. 1, 2 and 3, which illustrate a combination of a hearing aid 1, adapter shoe 2 and accessory 3 according to the prior art. The hearing aid 1 is a typical BTE, viz. Behind-The-Ear, type hearing aid, shown in the orientation as used, i.e. worn behind the ear. The hearing aid 1 comprises sound output 5, electrical contact pads 12 and hearing aid side walls 10 with shallow exterior recesses 11.

The accessory 3 in this cases comprises an FM receiver. The FIGS. 1, 2 and 3 further show the battery drawer 6 with wall 7 and the protruding lug 8, which serves to provide an easy grip for a nail or a finger, for use when opening the battery drawer. The battery drawer 6 is adapted in a manner known per se to serve as a power switch, so as to switch on the hearing aid when in the closed position, as shown in FIGS. 1 and 2, and to disconnect the power from the battery to the hearing aid when in the partially open position, shown in FIG. 3. FIG. 3 shows how the rear wall of the battery drawer 6 protrudes backwards, when the battery drawer is in the partially open position.

The adapter shoe 2 comprises a sleeve-like socket structure with slightly resilient sides, adapted for engaging the lower portion of the hearing aid 1 and fitted with inside protrusions (not shown) for engaging the hearing aid side recesses in order to secure the grip. The adapter shoe 2 comprises contact springs (not shown) for engaging the hearing aid contact pads. In the bottom, the adapter shoe 2 is provided with a socket (not shown) for connection with an FM receiver. Further details about the adapter shoe 2 may be found in WO-A-2004/080123.

The adapter shoe 2 generally encloses the lower portion of the hearing aid, though it leaves access to manipulate the hearing aid power switch.

Figure 4:
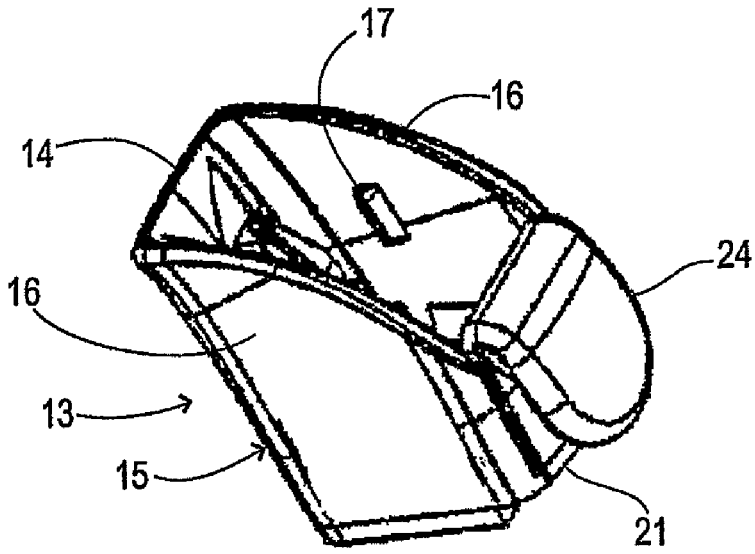
FIG. 4 illustrates an adapter shoe according to a first embodiment of the invention.
Figure 5:
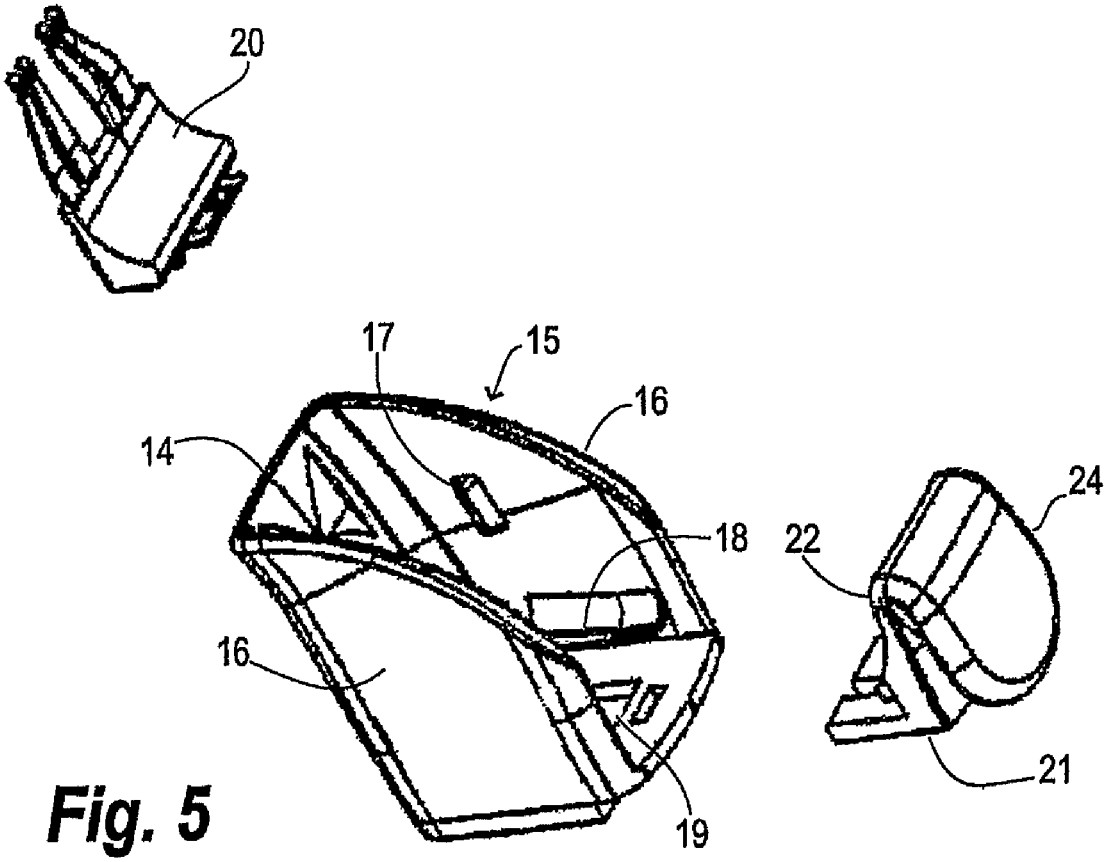
FIG. 5 illustrates the adapter shoe of FIG. 4 in exploded view.
Figure 6:
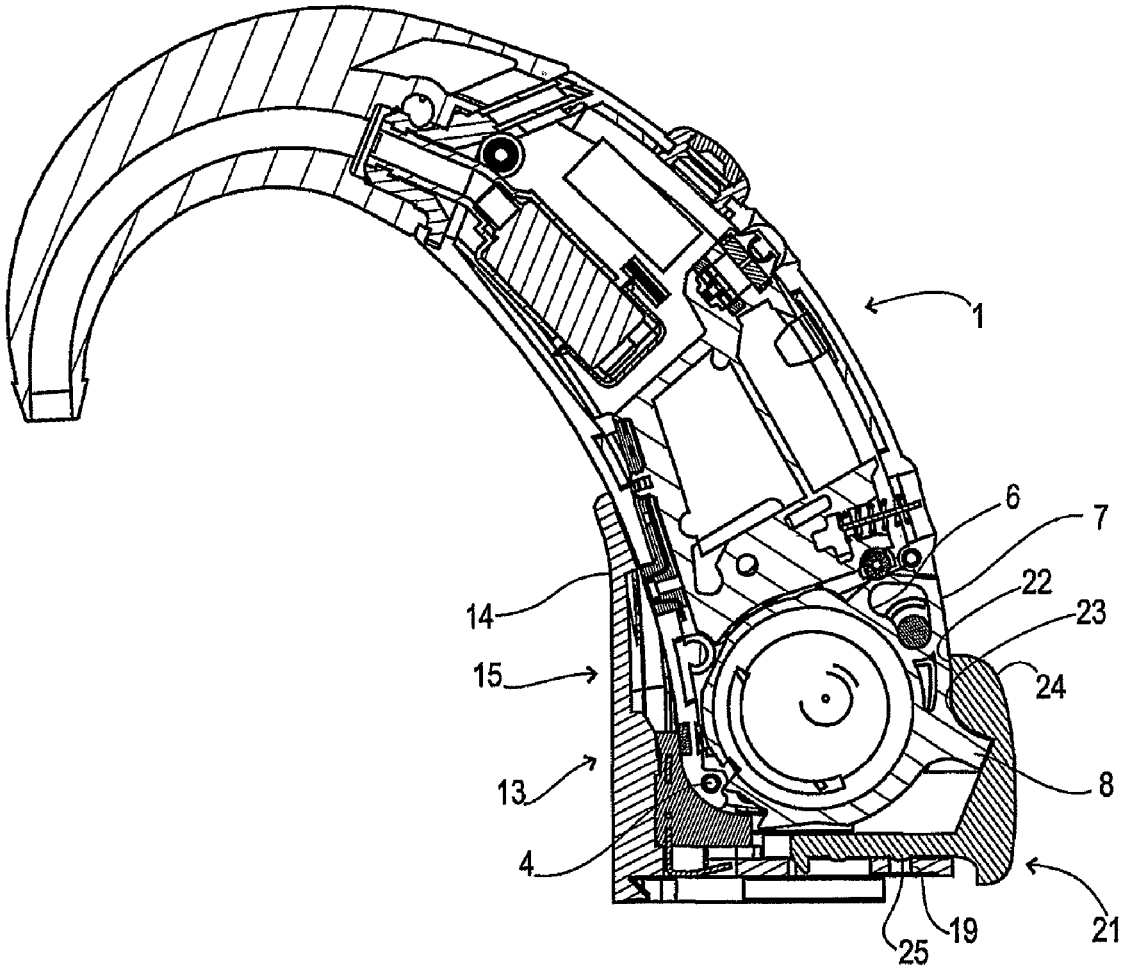
FIG. 6 illustrates the combination of the hearing aid, the adapter shoe of FIG. 4 and the accessory as assembled and in vertical section.

Reference is now made to FIGS. 4, 5 and 6, which show an adapter shoe 13 according to a first embodiment of the invention. FIG. 4 shows the adapter shoe 13 in assembled state, and FIG. 5 shows the adapter shoe 13 in exploded view. The adapter shoe 13 comprises front wall 14 and side walls 16. The side walls 16 have inside ribs 17 adapted for engaging the hearing aid side recesses (ref FIG. 1). As appears from the exploded view, the adapter shoe 13 comprises socket part 15 and a separate part, a slider 21, which slides in adapter shoe guides 18 and which closes the socket part to the rear. The slider 21 is retained by the guides 18 and held in the closed position by spring loaded snap lock means, generally comprising a small cam 25 of the slider 21 that engages a recess 19 of the adapter shoe. The adapter shoe 13 also has a bank of contacts 20 for providing electrical connection between contacts of the hearing aid 1 and the accessory 3 as will be understood by those skilled in the art.

The slider rear wall part 22 protrudes backwards, the backmost portion being formed with a kind of mushroom or knob 24 so as to offer a grip for engaging the slider by the nails to pull it backwards when required. When in the foremost position, the slider back wall completes the adapter shoe 13 so as to make it appear as a sleeve-like structure, enclosing the lower portion of the BTE hearing aid housing.

Reference is now made specifically to FIG. 6 which shows the combination of the hearing aid 1, the adapter shoe 13 of the first embodiment and the accessory 3 in vertical section in the symmetry plane. For ease of understanding, the section plane is referred to as a plane of symmetry, however this symmetry solely applies to the general exterior and certainly not to details of the components. The battery drawer is adapted for pivoting about the pivot 4 to switch the hearing aid on and off, as known in the art. The OFF position is the position where the battery drawer rear wall 7 protrudes rearwards. In the ON position, the battery drawer rear wall is flush with the hearing aid housing. Once the adapter shoe is in position on the hearing aid housing, the slider rear wall 22 blocks the battery drawer 6 by the battery drawer rear wall 7 so that it cannot pivot, and therefore must stay in the closed position, where the hearing aid is switched on.

FIG. 6 further shows how the adapter shoe 13 is provided with an inward nose-like catch 23 that engages the protruding lug 8 of the battery drawer 6. This engagement together with the engagement by the walls and by the ribs 17 in the recesses provides a very sturdy grip on the hearing aid housing.

When it is desired to switch off the hearing aid, the user will engage the knob 24 by his or her nails to pull backwards the slider 21, and he or she will then disengage the adapter from the hearing aid and press downwards the lug 8 to partially open the battery drawer 6.

Figure 7:
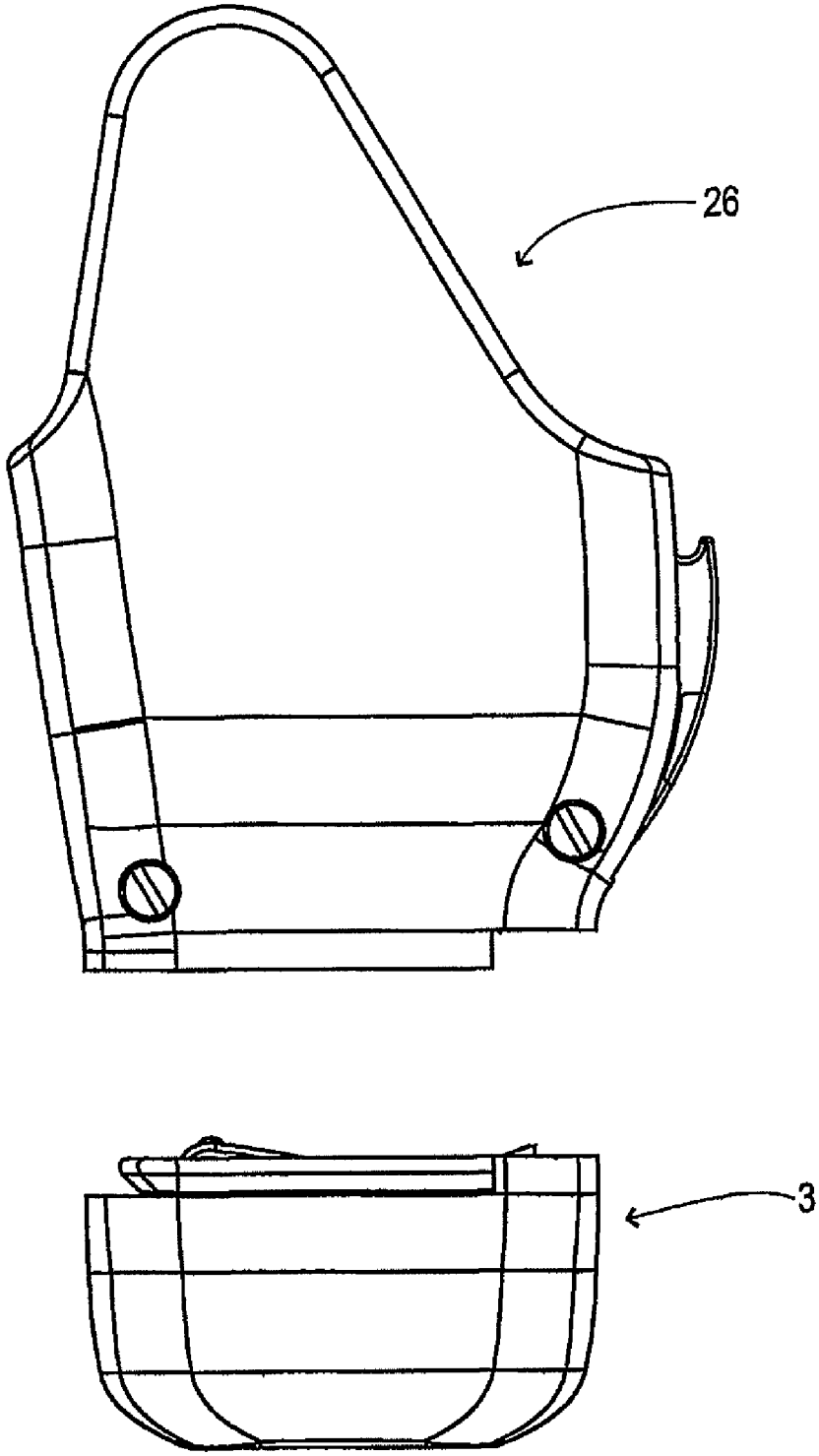
FIG. 7 illustrates an adapter shoe according to a second embodiment of the invention, and an accessory.
Figure 8:
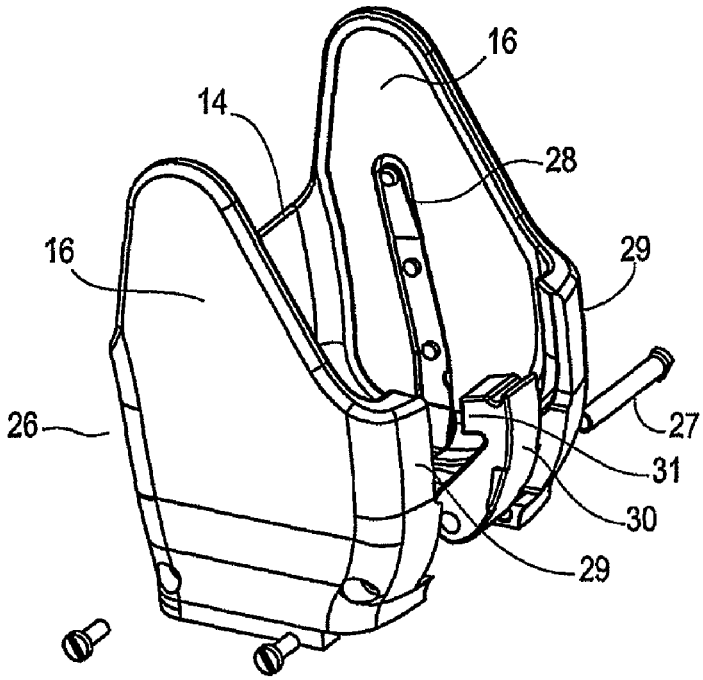
FIG. 8 illustrates the adapter shoe of FIG. 7 as seen from a different viewing angle.
Figure 9:
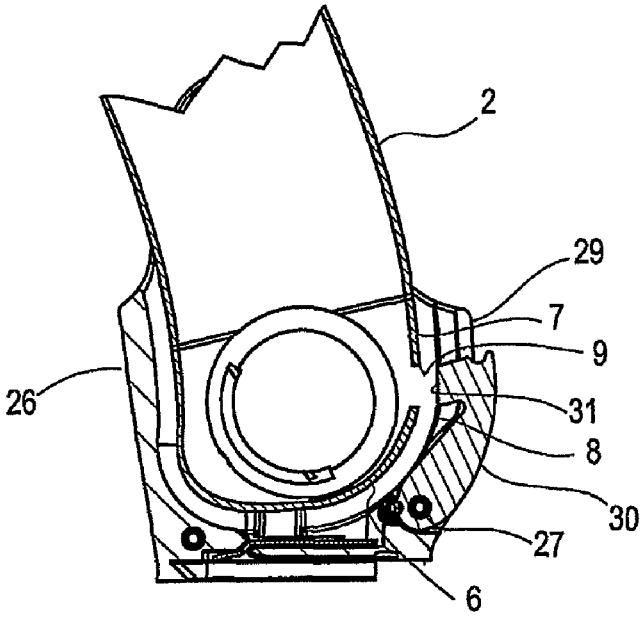
FIG. 9 shows the hearing aid and the adapter shoe of FIG. 7, in vertical section.

Reference is now made to FIGS. 7, 8 and 9 for a description of an adapter shoe 26 according to a second embodiment of the invention. FIG. 7 shows the adapter shoe 26 and an accessory 3, in a separated state. FIG. 8 shows the adapter shoe 26 in exploded view and from a different viewing angle, and FIG. 9 shows the hearing aid with the adapter shoe 26 in section by the symmetry plane.

As appears most clearly from FIG. 8, this adapter shoe 26 has slightly higher side walls 16 and it is assembled from two parts, which are held together by pin 27 and other details. Electrical contact springs 28 are arranged on the inside of one of the side walls 16. The front wall 14 is generally similar to that of the first embodiment; whereas the rear comprises lateral rear wall portions 29 at either side that protrudes to only partially close the space between the sides.

Between the rear wall portions, an arm 30 is fitted, pivotable about the pin 27. The arm is provided with a nose like hook 31.

The hearing aid has a slight modification in that the battery drawer wall is provided with an aperture 9. FIG. 9 shows how the arm 30 may pivot to engage by the hook 31 this aperture 9 in the battery drawer wall 7. This embodiment offers a way to obtain a secure grip even on a hearing aid where the lug on the battery drawer as such is too tiny to rely on for engagement.

This adapter shoe 26 is designed to engage by the rear wall portions 29 the battery drawer 6 so as to block pivoting once the adapter shoe 26 is in position on the hearing aid housing. Once the shoe is in place on the hearing aid housing, the arm 30 is pivoted forward so as to let the hook 31 engage the aperture 9 in the battery drawer, thereby to secure the engagement of the adapter shoe 26 with the hearing aid housing. The hook 31 is resilient and suitably designed so to snap into engagement with the aperture 9.

In a modification of this embodiment, not shown in the figures, the battery drawer has no aperture, and the arm 30 and the hook 31 are designed so as to engage the lug 8 on the battery drawer, thereby to secure the retention.

The invention claimed is:

1. A combination of a hearing aid and an adapter shoe, wherein the hearing aid has a housing and a pivotable battery compartment, and wherein the adapter shoe has engagement means for engaging the exterior of the hearing aid housing, a slider selectively slidable between a first position in which it permits pivoting of the battery compartment and a second position in which it engages the hearing aid housing and the battery compartment for blocking pivoting of the battery compartment, to thereby permit a user to selectively disable a hearing aid ON/OFF switch when the adapter shoe is in place, and snap lock means for engaging the battery compartment.

2. The combination according to claim 1, wherein the adapter shoe comprises front wall, rear wall portions and side walls, and wherein the rear wall portions provide blocking of the pivoting of the battery compartment.

3. The combination according to claim 1, wherein the battery compartment has a protruding lug, and wherein the snap lock means comprises a catch for engaging the lug.

4. The combination according to claim 1, wherein the battery compartment comprises a wall with an aperture, and wherein the snap lock means comprises a catch for engaging the aperture.

5. The combination according to claim 3, wherein the catch pivots into engagement.

6. The combination according to claim 1, wherein the adapter shoe has a pivotable arm for engaging a wall of the battery compartment.

7. The combination according to claim 1, comprising a power switch operated by pivoting the battery compartment.

8. An adapter shoe for a hearing aid having a housing and a pivotable battery compartment, wherein the adapter shoe has engagement means for engaging the exterior of the hearing aid housing, a slider selectively slidable between a first position in which it permits pivoting of the battery compartment and a second position in which it engages the hearing aid housing and the battery compartment for blocking pivoting of the battery compartment, to thereby permit a user to selectively disable a hearing aid ON/OFF switch when the adapter shoe is in place, and snap lock means for engaging the battery compartment.

9. A method of attaching an adapter shoe to a hearing aid having a housing and a pivotable battery compartment, comprising engaging the hearing aid housing and the battery compartment by the adapter shoe, and providing a slider selectively slidable between a first position in which it permits pivoting of the battery compartment and a second position in which it engages the hearing aid housing and the battery compartment to block pivoting of the battery compartment, to thereby permit a user to selectively disable a hearing aid ON/OFF switch when the adapter shoe is in place.

10. A combination of a hearing aid and an adapter shoe, wherein the hearing aid has a housing and a pivotable battery compartment, and wherein the adapter shoe has a slider selectively slidable between a first position in which it permits pivoting of the battery compartment and a second position in which it engages the hearing aid housing and the battery compartment to block pivoting of the battery compartment, to thereby permit a user to selectively disable a hearing aid ON/OFF switch when the adapter shoe is in place, and a pivotable arm for securing the engagement with the exterior of the hearing aid housing.

* * * * *